US008712287B2

(12) United States Patent
Paik

(10) Patent No.: US 8,712,287 B2
(45) Date of Patent: Apr. 29, 2014

(54) FUSING DEVICE TO PREVENT OVERHEATING OF A HEATING MEMBER AND IMAGE FORMING APPARATUS HAVING THE SAME

(75) Inventor: Sok Won Paik, Jeonju-si (KR)

(73) Assignee: Samsung Electronics Co., Ltd, Suwon-si (KR)

( * ) Notice: Subject to any disclaimer, the term of this patent is extended or adjusted under 35 U.S.C. 154(b) by 495 days.

(21) Appl. No.: 12/906,380

(22) Filed: Oct. 18, 2010

(65) Prior Publication Data

US 2011/0103852 A1 May 5, 2011

(30) Foreign Application Priority Data

Nov. 3, 2009 (KR) ..... 10-2009-105537

(51) Int. Cl.
*G03G 15/08* (2006.01)
*G03G 15/20* (2006.01)

(52) U.S. Cl.
USPC ..... 399/120; 399/328

(58) Field of Classification Search
USPC ..... 399/122, 330, 333, 334, 328
See application file for complete search history.

(56) References Cited

U.S. PATENT DOCUMENTS

| | | | | |
|---|---|---|---|---|
| 2002/0006296 | A1* | 1/2002 | Omoto et al. | 399/330 |
| 2007/0041757 | A1* | 2/2007 | Tajima et al. | 399/328 |
| 2009/0175664 | A1* | 7/2009 | Nanjo et al. | 399/330 |

* cited by examiner

*Primary Examiner* — Joseph S Wong
(74) *Attorney, Agent, or Firm* — Stanzione & Kim, LLP

(57) ABSTRACT

A fusing device to prevent overheating of a heating member includes a heating member having a heat emitting part disposed to transfer heat to recording media, an induction coil to create a magnetic field acting upon the heat emitting part, at least one magnetic body disposed around the induction coil, and an inductor cover disposed between the heating member and the magnetic body. The heating member includes a first region corresponding to a size of the recording media passing through the heating member and a second region outside the first region. The inductor cover includes at least one opening formed to correspond to the second region of the heating member such that heat generated from the heating member is directly radiated to the magnetic body.

24 Claims, 11 Drawing Sheets

FUSING DEVICE TO PREVENT OVERHEATING OF A HEATING MEMBER AND IMAGE FORMING APPARATUS HAVING THE SAME

CROSS-REFERENCE TO RELATED APPLICATIONS

This application claims the benefit of priority under 35 U.S.C. §119 to Korean Patent Application No. 2009-0105537, filed on Nov. 3, 2009 in the Korean Intellectual Property Office, the disclosure of which is incorporated herein by reference in its entirety.

BACKGROUND

1. Field of the Invention

Embodiments of the present general inventive concept relate to an induction heating type fusing device and an image forming apparatus using the same.

2. Description of the Related Art

An image forming apparatus forms an image on recording media, such as paper, transparency, photographic material, etc. The image forming apparatus may be embodied by a printer, a copier, a facsimile and a multifunction device having functions of the printer, the copier, and the facsimile.

An electrophotographic image forming apparatus scans light onto a photosensitive body charged with potential to form an electrostatic latent image on the surface of the photosensitive body, and supplies a developing agent to the latent image to form a visible image. The visible image formed on the photosensitive body is directly transferred to recording media or is transferred to the recording media via an intermediate transfer member. The visible image transferred to the recording media is fixed to the recording media by a fusing device.

Generally, the fusing device includes a heating member to apply heat to the recording media. The heating member may be heated by induction heating. The induction heating type fusing device supplies current to a coil to generate an eddy current in the heating member and achieves emission of heat from the heating member using Joule's heat generated by resistance of the heating member.

SUMMARY

It is an aspect of the present general inventive concept to provide an improved induction heating type fusing device that prevents overheating of a heating member and an image forming apparatus using the same.

Additional aspects of the general inventive concept will be set forth in part in the description which follows and, in part, will be obvious from the description, or may be learned by practice of the general inventive concept.

Features and/or utilities of the present general inventive concept may be realized by a fusing device that includes a heating member having a heat emitting part disposed to transfer heat to recording media, an induction coil disposed to create a magnetic field acting upon the heat emitting part, at least one magnetic body disposed around the induction coil to concentrate the magnetic field created by the induction coil on the heat emitting part, and an inductor cover disposed between the heating member and the at least one magnetic body. The heating member may include a first region corresponding to a size of the recording media passing through the heating member and a second region outside the first region, the inductor cover including at least one opening formed at a portion corresponding to the second region of the heating member such that heat generated from the heating member is directly radiated to the at least one magnetic body.

The at least one magnetic body may include at least one first magnetic body disposed to correspond to the first region of the heating member and at least one second magnetic body disposed to correspond to the second region of the heating member.

The second magnetic body may have lower Curie temperature than the first magnetic body.

The developing device may further include a heat transfer layer made of a material exhibiting higher heat conductivity than the second magnetic body and attached to at least a portion of the second magnetic body.

The second magnetic body may include an inner surface facing the induction coil and an outer surface disposed at a side opposite to the inner surface, and the heat transfer layer may be attached to the outer surface of the second magnetic body.

The second magnetic body may be partially exposed outside the inductor cover toward the heating member.

The first magnetic body and the second magnetic body each may have an end located adjacent to the heating member, and the end of the second magnetic body may be disposed closer to the heating member than that of the first magnetic body.

The at least one second magnetic body may include a plurality of second magnetic bodies arranged in a longitudinal direction of the heating member, and the at least one opening may be disposed to correspond to each of the second magnetic bodies.

The second magnetic body may include at least one protrusion protruding toward the at least one opening.

The developing device may further include a heat insulation wall disposed between the first magnetic body and the second magnetic body in a longitudinal direction of the heating member.

In accordance with another aspect of the present general inventive concept, an image forming apparatus includes a printing device to form an image on recording media and a fusing device to fix the image to the recording media, the fusing device including a heating member rotatably disposed to transfer heat to the recording media, the heating member having a first region located at a middle thereof in an axial direction thereof and second regions located at opposite sides of the first region, an inductor cover disposed to cover an outer surface of the heating member along the axial direction of the heating member, an induction coil disposed at a side opposite to the heating member with respect to the inductor cover to create a magnetic field, at least one first magnetic body disposed around the induction coil to concentrate the magnetic field created by the induction coil on the first region of the heating member, and at least one second magnetic body disposed around the induction coil to concentrate the magnetic field created by the induction coil on each of the second regions of the heating member, the inductor cover including at least one opening formed to allow heat radiated from the heating member to pass through the inductor cover and reach the at least one second magnetic body.

The second magnetic body may have an end located adjacent to the heating member, and the end of the second magnetic body may be exposed outside the inductor cover toward the heating member.

The at least one opening may include a plurality of openings arranged at intervals along a circumferential direction of the heating member, and the induction coil may be disposed between the openings in the circumferential direction of the heating member.

The at least one opening may be disposed at a middle of the induction cover in a circumferential direction of the heating member, and the induction coil may be disposed at opposite sides of the opening in the circumferential direction of the heating member.

Features and/or utilities of the present general inventive concept may also be realized by a fusing apparatus including a heating unit to heat a recording medium, an induction coil to create a magnetic field to cause the heating unit to emit heat, a first magnetic body located over a first region of the heating unit to concentrate the magnetic field created by the induction coil on the first region heat emitting part, and a second magnetic body located over a second region of the heating unit to concentrate the magnetic field created by the induction coil on the second region of the heat emitting part, the second magnetic body separated from the first magnetic body in a longitudinal direction of the heating unit. The second magnetic body may be positioned over the second region of the heating unit to receive a greater magnitude of heat from the heating unit than the first magnetic body receives from the heating unit.

The fusing apparatus may include an inductor cover positioned between the first and second magnetic bodies and the heating unit, and the inductor cover may include at least one opening at a location corresponding to the position of the second magnetic body to transmit heat directly to the second magnetic body from the heating unit.

The inductor cover may include an extension to cover an end of the first magnetic body, and an end of the second magnetic body may be exposed to the heating unit and may not be covered by the extension.

An end of the second magnetic body may extend past an end of the inductor cover to be exposed to the heating unit. An end of the second magnetic body may be closer to the outer surface of the heating member than an end of the first magnetic body.

The second magnetic body may include a protrusion that extends from a center part of the second magnetic body to the opening of the inductor cover to receive heat from the heating unit via the opening of the inductor cover.

The second magnetic body may have a Curie temperature lower than a Curie temperature of the first magnetic body.

The heating unit may be a roller to rotate about a longitudinal axis, the first magnetic body may include a plurality of first magnetic bodies, each having a curved surface adjacent to the surface of the heating unit to correspond to a curvature of the surface of the heating unit, and the second magnetic body may include a plurality of second magnetic bodies having, each having a curved surface adjacent to the surface of the heating unit to correspond to a curvature of the surface of the heating unit.

The second magnetic body may include first and second pluralities of second magnetic bodies located on either side of the first magnetic body in the longitudinal direction of the heating unit.

Features and/or utilities of the present general inventive concept may also be realized by an image forming apparatus including a printing device to form an image on recording media and a fusing apparatus. The fusing apparatus may include a heating unit to heat a recording medium, an induction coil to create a magnetic field to cause the heating unit to emit heat, a first magnetic body located over a first region of the heating unit to concentrate the magnetic field created by the induction coil on the first region heat emitting part, and a second magnetic body located over a second region of the heating unit to concentrate the magnetic field created by the induction coil on the second region of the heat emitting part, the second magnetic body separated from the first magnetic body in a longitudinal direction of the heating unit. The second magnetic body may be positioned over the second region of the heating unit to receive a greater magnitude of heat from the heating unit than the first magnetic body receives from the heating unit.

BRIEF DESCRIPTION OF THE DRAWINGS

These and/or other aspects of the general inventive concept will become apparent and more readily appreciated from the following description of the embodiments, taken in conjunction with the accompanying drawings of which.

DETAILED DESCRIPTION OF THE EMBODIMENTS

Figure 1:
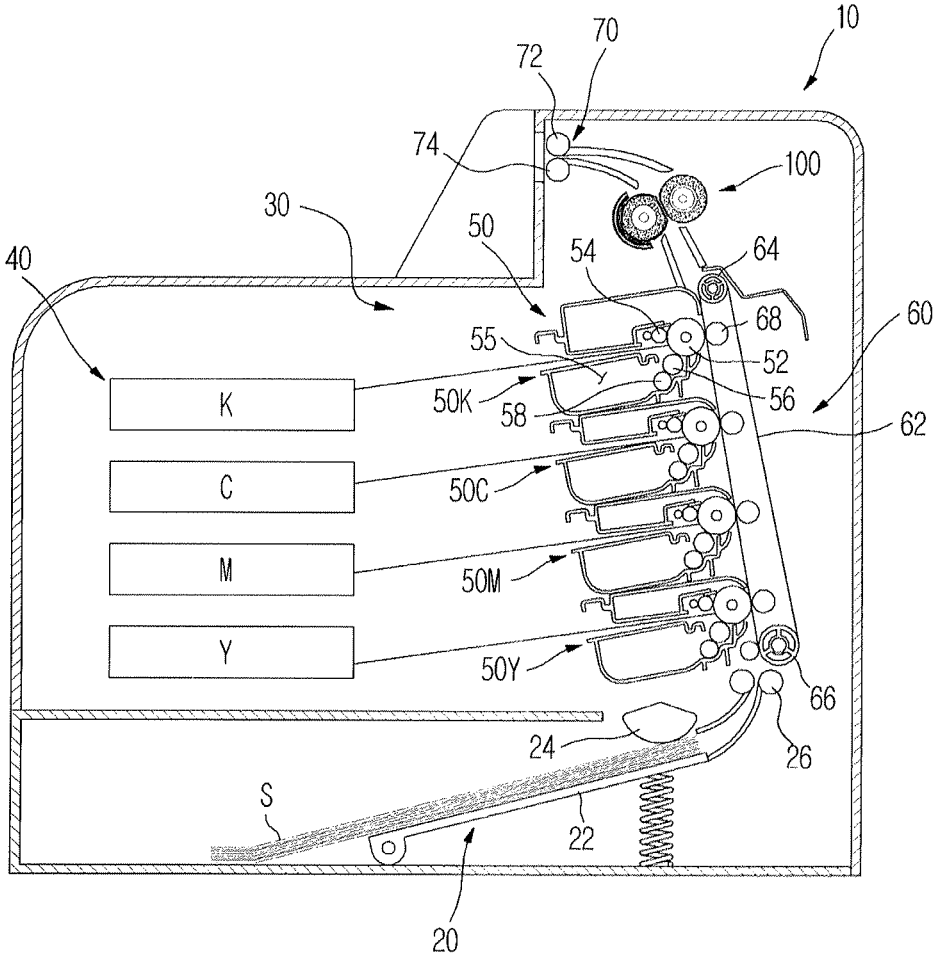
FIG. 1 is a construction view of an image forming apparatus according to an embodiment of the present general inventive concept.

Reference will now be made in detail to the embodiments of the present general inventive concept, examples of which are illustrated in the accompanying drawings, wherein like reference numerals refer to like elements throughout. The embodiments are described below in order to explain the present general inventive concept by referring to the figures.

FIG. 1 illustrates an image forming apparatus 1 according to an embodiment of the present general inventive concept.

As shown in FIG. 1, the image forming apparatus 1 includes an apparatus body 10, a recording media supply device 20, a printing device 30, a fusing device 100, and a recording media discharging device 70.

The apparatus body 10 defines the external appearance of the image forming apparatus and supports various components disposed inside the image forming apparatus. The apparatus body 10 includes a cover (not shown) to open and close a portion of the apparatus body 10 and an apparatus body frame (not shown) to support or fix various components within the apparatus body 10.

The recording media supply device 20 supplies recording media S to the printing device 30. The recording media supply device 20 includes a tray 22 in which the recording media S are loaded and a pickup roller 24 to pick up the recording media in the tray 22 one by one. The recording media picked-up by the pickup roller 24 are fed to the printing device 30 by a feeding roller 26.

The printing device may include an optical scanning device 40, a developing device 50, and a transfer device 60.

The optical scanning device 40, including a scanning optical system (not shown), scans light corresponding to image information of yellow (Y), magenta (M), cyan (C) and black (K) to the developing device 50 according to a printing signal.

The developing device 50 forms a visible image on a photosensitive body 52 according to image information input from external equipment, such as a computer. In this embodiment, the image forming apparatus 1 is a color image forming apparatus in which the developing device 50 includes four developing units 50Y, 50M, 50C, and 50K to contain different color toners, e.g., yellow (Y), magenta (M), cyan (C) and black (K) toners, respectively.

Each of the developing units 50Y, 50M, 50C, and 50K may include a photosensitive body 52, a charge roller 54, a developing agent storing chamber 55, a developing roller 56, and a supply roller 58. The charge roller 54 charges the surface of the photosensitive body 52 with predetermined potential. The optical scanning device 40 scans light to the surface of the charged photosensitive body 52 to form an electrostatic latent image. The developing agent stored in the developing agent storing chamber 55 is supplied to the developing roller 56 by the supply roller 58. The developing roller 56 supplies the developing agent to the electrostatic latent image formed on the photosensitive body 52 to form a visible image.

The transfer device 60 transfers the visible image formed on the photosensitive body 52 to recording media. The transfer device 60 may include a transfer belt 62 to travel in circulation while being in contact with the respective photosensitive bodies 52, a transfer belt drive roller 64 to drive the transfer belt 62, a tension roller 66 to maintain tension of the transfer belt 62, and four transfer rollers 68 to transfer the visible images formed on the respective photosensitive bodies 52 to recording media.

The recording media are fed at the same speed as the travel speed of the transfer belt 62. At this time, voltages having polarities opposite to those of the developing agent attached to the respective photosensitive body 52 are applied to the respective transfer rollers 68, with the result that developing agent images on the photosensitive bodies 52 are transferred to the recording media.

The fusing device 100 fixes the developing agent images transferred to the recording media by the transfer device 60 to the recording media. The fusing device 100 is configured to apply heat to the recording media using an induction heating method. Details of the fusing device 100 will be described later.

Meanwhile, the recording media discharging device 70 discharges the recording media out of the apparatus body 10. The recording media discharging device 70 includes a discharging roller 72 and a pinch roller 74 disposed facing the discharging roller 72.

Figure 2:
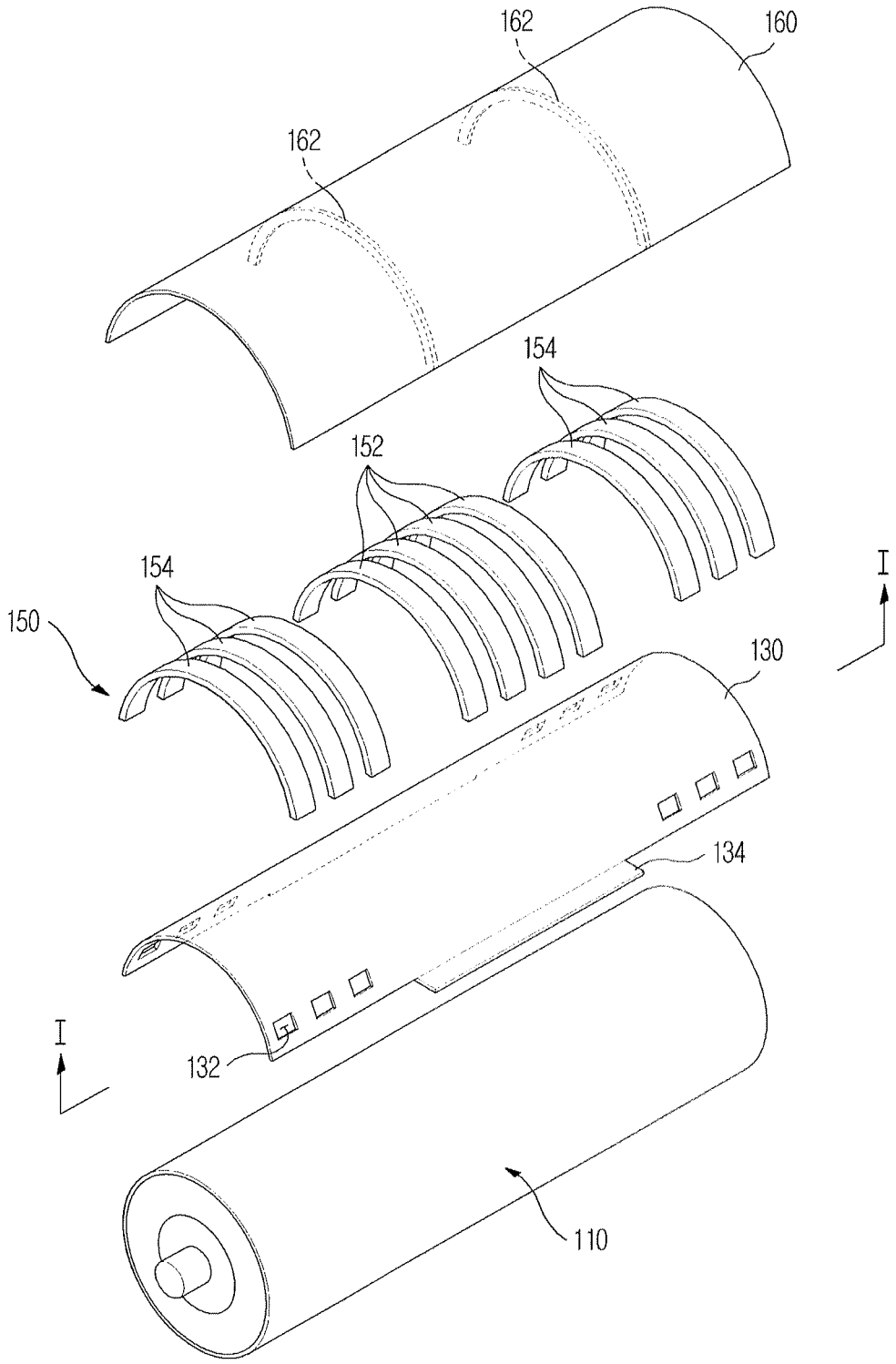
FIG. 2 is a perspective view illustrating a fusing device according to an embodiment of the present general inventive concept.
Figure 3:
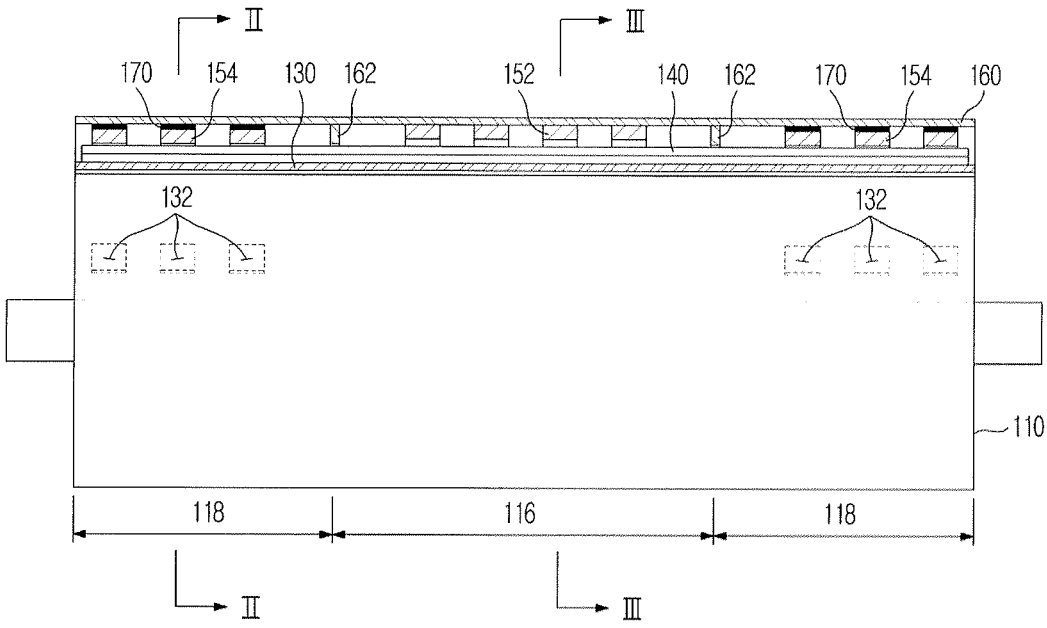
FIG. 3 is a sectional view taken along line I-I of FIG. 2.

FIG. 2 is a perspective view illustrating a fusing device according to an embodiment of the present general inventive concept, and FIG. 3 is a sectional view taken along line I-I of FIG. 2. FIGS. 4 and 5 are sectional views respectively taken along lines II-II and III-III of FIG. 3. An induction coil and a pressing member are omitted from FIG. 2, and the pressing member is shown in FIGS. 4 and 5.

The fusing device 100 includes a heating member 110, a pressing member 120, an inductor cover 130, an induction coil 140, and a magnetic flux shielding unit 150.

The recording media S to which the image is transferred pass through a space between the heating member 110 and the pressing member 120. At this time, the image is fixed to the recording media by heat and pressure.

As shown in FIGS. 4 and 5, the pressing member 120 is disposed in contact with the outer circumference of the heating member 110 to form a fusing nip N between the pressing member 120 and the heating member 110. The pressing member 120 is elastically pressed toward the heating member 110 by a pressing unit (not shown) such that the pressing member 120 is in pressure contact with the heating member 110.

The pressing member 120 may be configured in the form of a roller. The pressing member 120 includes a shaft 122 made of metal, such as aluminum or steel, and an elastic layer 124 to surround the shaft 122. The elastic layer 124 is generally formed of silicon rubber. A release layer 126 to prevent recording media from being attached to the pressing member is provided at the surface of the elastic layer 124.

The heating member 110 includes a heat emitting part 111. The heating member 110 is disposed to transfer heat to recording media passing through the fusing nip N. Similarly to the pressing member 120, the heating member 110 may be configured in the form of a roller including a shaft 112, an elastic layer 113 and a release layer 114.

The heat emitting part 111 is received in the elastic layer 113. The heat emitting part 111 is disposed adjacent to the outer circumference of the heating member 110 to effectively transfer heat to recording media. The heat emitting part 111 may be made of a conductive material, such as metal. The heat emitting part 111 may be configured in the form of a thin film to reduce heat capacity.

An example in which the heat emitting part 111 is received in the elastic layer 113 is shown in FIGS. 4 and 5. Alternatively, the heating member 110 may be configured in the form of a hollow pipe, and the pipe may function as a heat emitting body. Also, the heating member 110 may be configured in the form of a film or belt in place of the roller.

As shown in FIG. 3, the outer surface of the heating member 110 has a first region 116 located at the middle of the heating member 110 in the axial direction of the heating member 110 and second regions 118 located at opposite sides of the first region 116 in the axial direction of the heating member 110. When the image forming apparatus performs a printing operation with respect to small-sized recording media, the first region 116 corresponds to the size of recording media.

When the small-sized recording media (for example, envelopes) S pass through the fusing nip N, the first region 116 corresponding to the size of the recording media contacts the recording media, and the second regions 118 do not contact the recording media. The terms large-sized and small-sized refer to the widths of the recording media with respect to the axial direction, or in other words a longitudinal direction, of the heating member 110 when the recording media are transmitted between the heating member 110 and the pressing member 120. In other words, a small-sized recording media is any media that has a width in the axial direction of the heating member 110 that is less than that of a "large-sized" media. A large-sized media is any media that has a width in the axial direction of the recording media to be located on a portion of the heating member 110 that corresponds to an area under one or more of the second magnetic bodies 154. A small-sized media may be located on a portion of the heating member 110 that corresponds only to the first magnetic bodies 152.

Alternatively, the small-sized recording media may be located on a portion of the heating member that corresponds to the first magnetic bodies 152 and a number of the second magnetic bodies 154 less than the number that corresponds to the large-sized recording media. For example, referring to FIG. 2, if a large-sized recording medium has a width corresponding to all of the first magnetic bodies 152 and two of the three second magnetic bodies 154 on either side of the first magnetic bodies 152, then the small-sized recording medium may have a width that corresponds to the first magnetic bodies 152 and only one of the second magnetic bodies 154 on either side of the first magnetic bodies 152.

As shown in FIGS. 3 to 5, the induction coil 140 is disposed to create a magnetic field which acts with respect to the heat emitting part 111. The induction coil 140 is disposed adjacent to the outer circumference of the heating member 110. The induction coil 140 may include a Litz wire formed by twisting several thin copper wires each coated with an insulating coating layer.

When predetermined AC current is supplied to the induction coil 140 through a power supply circuit (not shown), an AC magnetic field is created around the induction coil 140, and the AC magnetic field generates induction current at the heat emitting part 111 of the heating member 110. The heat emitting part 111 has specific resistance, and therefore, the heat emitting part 111 emits heat corresponding to the induction current.

The inductor cover 130 is disposed between the heating member 110 and the induction coil 140. The inductor cover 130 covers the outer surface of the heating member 110 along the axial direction of the heating member 110. Also, the inductor cover 130 is disposed to cover a portion of the heating member 110 in the circumferential direction of the heating member 110. The inductor cover 130 may be bent along the outer circumference of the heating member 110. The shape of the inductor cover 130 may correspond to the shape of the outer surface of the heating member 110 in each of an axial direction and a circumferential direction, as illustrated in FIGS. 2-5.

The inductor cover 130 serves to prevent heat emitted from the heating member 110 from being directly transferred to the induction coil 140 or the magnetic flux shielding unit 150. The inductor cover 140 may be formed of a material exhibiting excellent heat resistance, heat insulation and electrical insulation. For example, the inductor cover 130 may be formed of a complex material containing glass fiber.

The induction coil 140 may be fixed to the inductor cover 130. The induction coil 140 may be attached to the outer surface of the inductor cover 130 by a bonding agent or may be fixed to the inductor cover 130 through an additional structure (not shown) such as screws, welds, braces, clamps, or any other appropriate structure.

The magnetic flux shielding unit 150 is disposed around the induction coil 140 to concentrate a magnetic field created by the induction coil 140 on the heat emitting part 111 of the heating member 110. The magnetic flux shielding unit 150 may include a plurality of magnetic bodies 152 and 154 disposed in the axial direction of the heating member 110. The magnetic bodies 152 and 154 may be made of iron, nickel, cobalt, or an alloy thereof. Alternatively, the magnetic bodies 152 and 154 may be made of a ferrite material containing iron oxide, manganese oxide, and zinc oxide.

The magnetic bodies 152 and 154 may each include a plurality of magnetic bodies spaced apart from each other in the axial direction of the heating member 110 and curved to have a shape corresponding to the circumference of the heating member 110.

An outer cover 160 may be disposed outside the magnetic bodies 152 and 154, and the magnetic bodies 152 and 154 may be fixed to the outer cover 160. The outer cover 160 is disposed to cover the magnetic bodies 152 and 154, the induction coil 140 and the inductor cover 130, which are disposed inside the outer cover 160.

The first magnetic body 152 is disposed to correspond to the first region 116 of the heating member 110, and the second magnetic body 154 is disposed to correspond to each of the second regions 118 of the heating member 110. A plurality of first magnetic bodies 152 and a plurality of second magnetic bodies 154 may be provided.

When printing small-sized recording media S, the first region 116 of the heating member 110 transfers heat to the recording media while being in contact with the recoding media. During printing, since the heating member 110 transfers heat to the small-sized recording media S, the first region 116 of the heating member 110 does not easily overheat. However, the second regions 118 of the heating member 110 do not contact the small-sized recording media S, with the result that temperature suddenly increases at the second regions 118 of the heating member 110 during printing. When the second regions 118 of the heating member 110 overheat, not only the heating member 110 but also various components disposed around the heating member 110 may be deteriorated or damaged, and an accident may occur.

The inductor cover 130 has at least one opening 132 formed to correspond to each of the second regions 118 of the heating member 110. The opening 132 formed in the inductor cover 130 allows heat radiated from the heating member 110 to pass through the inductor cover 130 and to be directly transferred to the second magnetic body 154 corresponding to each of the second regions 118 of the heating member 110, thereby facilitating the increase in temperature of the second magnetic body 154.

The at least one opening 132 may include a plurality of openings 132 to correspond to a respective plurality of second magnetic bodies 154. For example, as illustrated in FIG. 2, if there are three second magnetic bodies 154 on one side of the heating member, the inductor cover 130 may include three corresponding openings 132. Alternatively, the inductor cover 130 may include one opening 132 that spans across each of the second magnetic bodies 154, but not across the first magnetic bodies 152. In other words, while the inductor cover 130 is located between the first magnetic bodies 152 and the heating member 110, the inductor cover is not located between the second magnetic bodies 154 and the heating member 110 at the portion of the inductor cover 130 having the openings 132.

When the temperature of the second magnetic body 154 increases, the temperature of the second magnetic body 154 increases. When the temperature of the second magnetic body 154 reaches Curie temperature, the second magnetic body 154 loses magnetism and thus loses its function as the magnetic flux shielding unit. As a result, the magnetic field created by the induction coil 140 does not concentrate on the second regions 118 of the heating member, and the induction heating efficiency at the second regions 118 of the heating member 110 is suddenly reduced. Consequently, overheating of the heating member 110 is prevented.

Thus, overheating of the heating member 110 may be prevented using a simple structure.

In particular, the plurality of openings 132 may be provided to correspond to the respective second magnetic bodies 154. Also, the openings 132 may be disposed at predetermined intervals in the circumferential direction of the heating member 110. The induction coil 140 may be disposed between the openings 132 in the circumferential direction of the heating member 110 such that the induction coil 140 does not cover the openings 132 formed in the inductor cover 130.

The temperature of the second magnetic body 154 may exceed Curie temperature at an appropriate point of time to prevent each of the second regions 118 of the heating member 110 from overheating. On the other hand, the first region 116 of the heating member 110 transfers heat to recording media in contact with the recording media. During the operation of the fusing device 100, therefore, the temperature of the first magnetic body 152 may not exceed Curie temperature, thereby ensuring the performance of the fusing device.

The Curie temperature of the second magnetic body 154 may be lower than that of the first magnetic body 152. For example, the second magnetic body 154 may be made of a material having a Curie temperature of 80 to 250° C., and the first magnetic body 152 may be made of a material having a higher Curie temperature than the material for the second magnetic body 154.

As shown in FIG. 4, a heat transfer layer 170 may be attached to at least a portion of the second magnetic body 154. The heat transfer layer 170 facilitates heat transfer to and spread in the second magnetic body 154 such that the second magnetic body 154 rapidly responds to the increase in temperature of the heating member 110.

The heat transfer layer 170 is made of a material exhibiting higher heat conductivity than the second magnetic body 154. The heat transfer layer 170 may be coated on the surface of the second magnetic body 154 by chemical deposition or plating. Also, the heat transfer layer 170 may be attached to or coated on the second magnetic body 154 using a physical method.

The heat transfer layer 170 may be formed at the outer surface of the second magnetic body 154, i.e., the surface of the second magnetic body 154 opposite to the inner surface of the second magnetic body 154 facing the induction coil 140, to minimize an effect of the heat transfer layer 170 with respect to the function of the second magnetic body 154.

Ends 154*c* of the second magnetic body 154 may be disposed adjacent to the heating member 110. Also, the ends 154*c* of the second magnetic body 154 may be exposed outside the inductor cover 130 toward the heating member 110. In other words, the second magnetic body 154 may be defined as having a first side closer to the heating member 110, a second side opposite the first side, and ends 154*c* connecting the first side and the second side. The ends 154*c* may extend substantially in a radial direction with respect to a center of the heating member 110, a tangential direction with respect to an outer circumference of the heating member 110, or any other direction to connect the first side and the second side of the second magnetic body 154.

The ends 154*c* of the second magnetic body 154 may extend past an end of the inductor cover 130, so that no structure is located between the portion of the second magnetic body 154 adjacent to the ends 154*c* and the outer surface of the heating member 110. In this structure, heat emitted from the heating member 110 directly heats the ends 154*c* of the second magnetic body 154 and the portions adjacent to the ends 154*c* of the second magnetic body 154, and the second magnetic body 154 rapidly responds to the increase in temperature of the heating member 110, thereby effectively preventing overheating of each of the second regions 118 of the heating member 110.

On the other hand, ends 152*c* of the first magnetic body 152 adjacent to the heating member 110 may be isolated from the heating member 110. The inductor cover 130 has extensions 134 formed to correspond to the first region 116 of the heating member 110. The extensions 134 extend between the ends 152*c* of the first magnetic body 152 and the heating member 110 to isolate the ends 152*c* of the first magnetic body 152 from the heating member 110.

Also, the ends 154*c* of the second magnetic body 154 adjacent to the heating member may be disposed closer to the heating member 110 than the ends 152*c* of the first magnetic body 152 adjacent to the heating member 110. In this structure, heat radiated from each of the second regions 118 of the heating member 110 is rapidly absorbed by the second magnetic body 154, thereby more effectively preventing overheating of the heating member 110. Also, deterioration of fusing performance at the opposite ends of the heating member 110 due to temperature lowering is prevented during printing of large-sized recording media (for example, A4 paper).

Figure 4A:
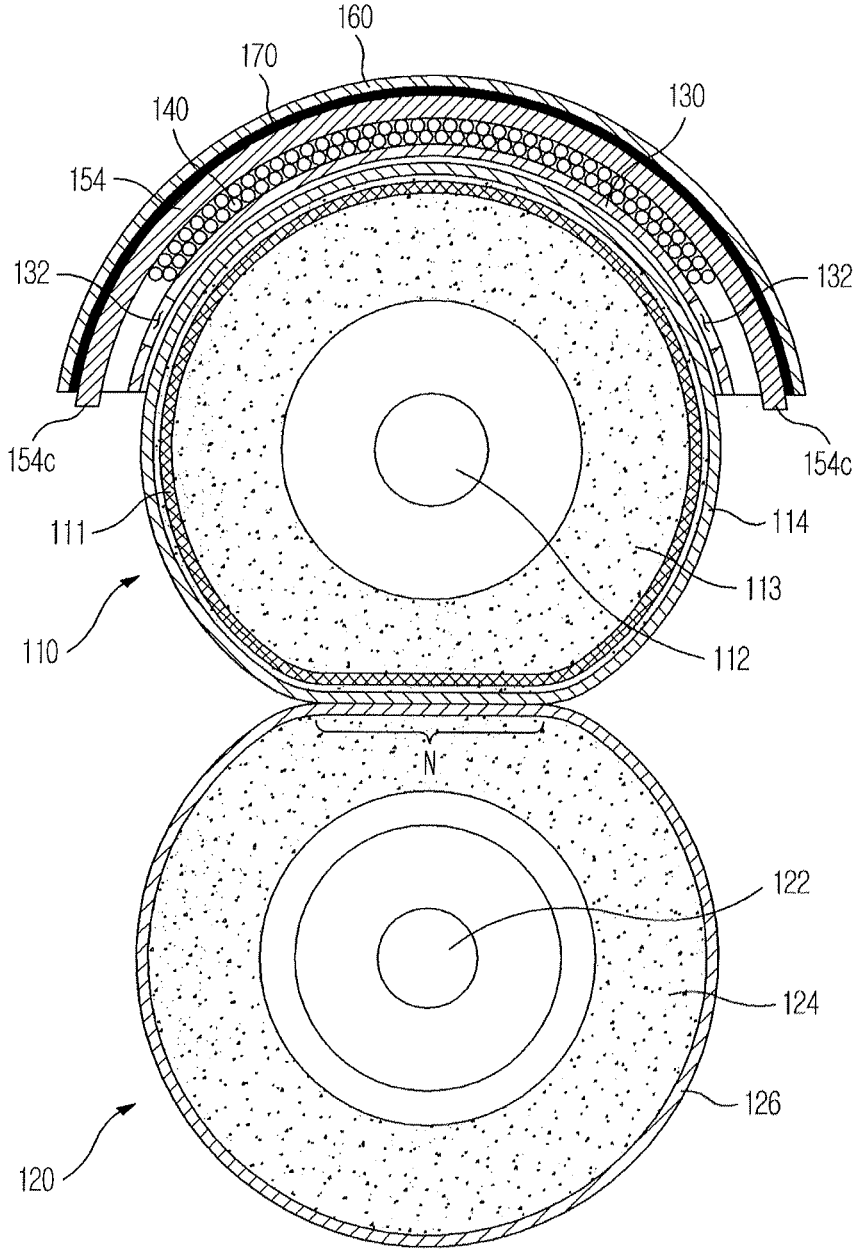
FIGS. 4A and 5 are sectional views respectively taken along lines II-II and III-III of FIG. 3.
Figure 4B:
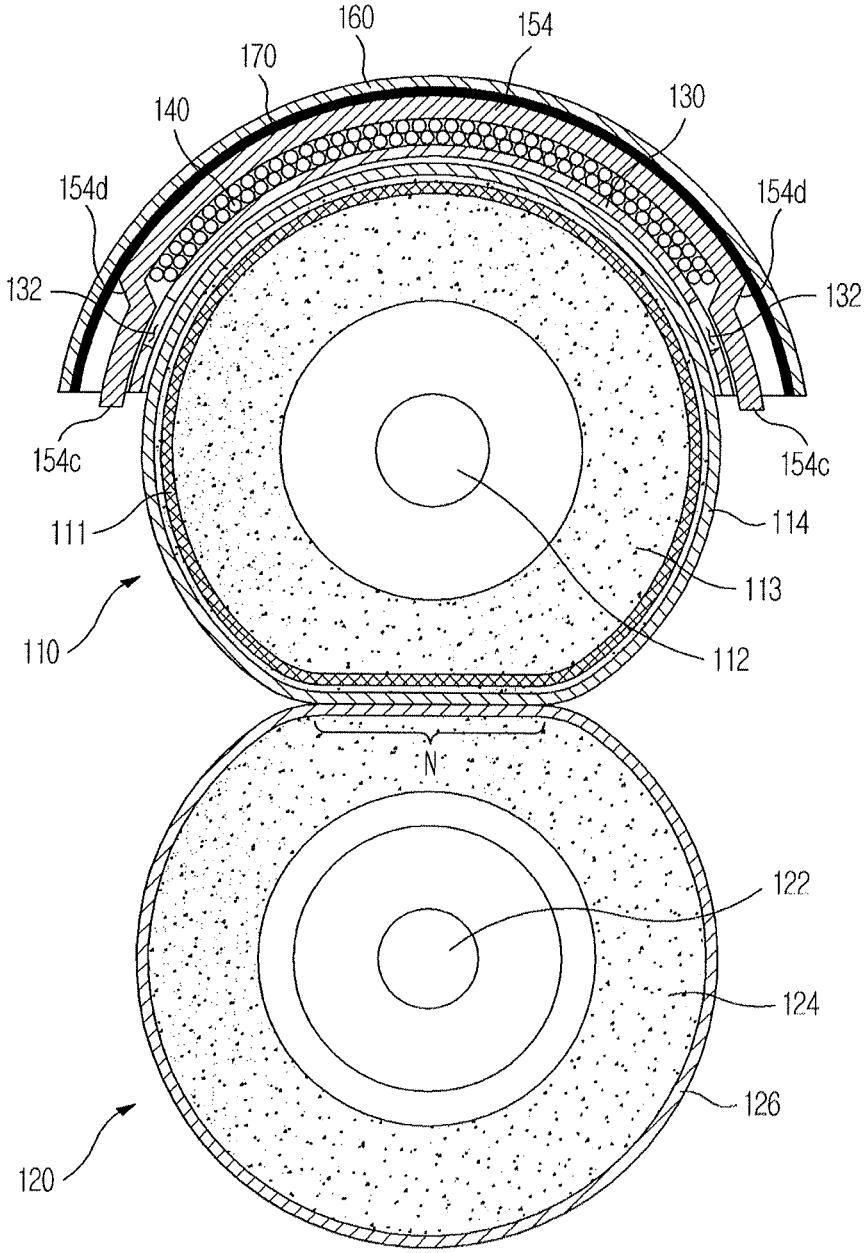
FIGS. 4B, 4C, and 4D are cross-sectional views of a fusing apparatus.
Figure 4C:
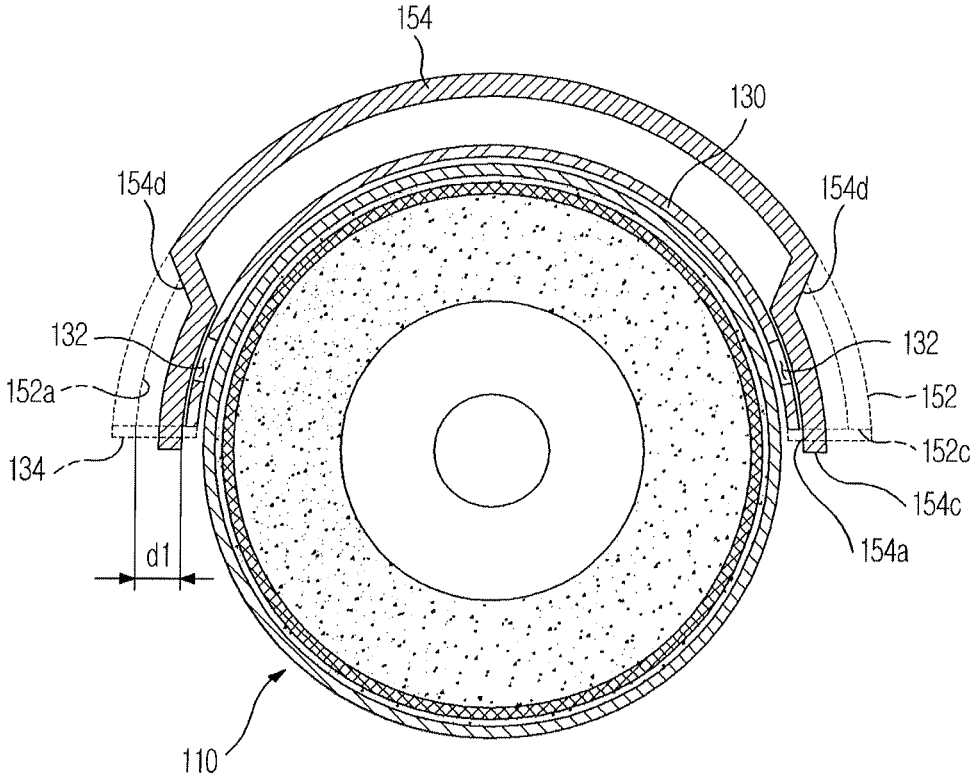
Figure 4D:
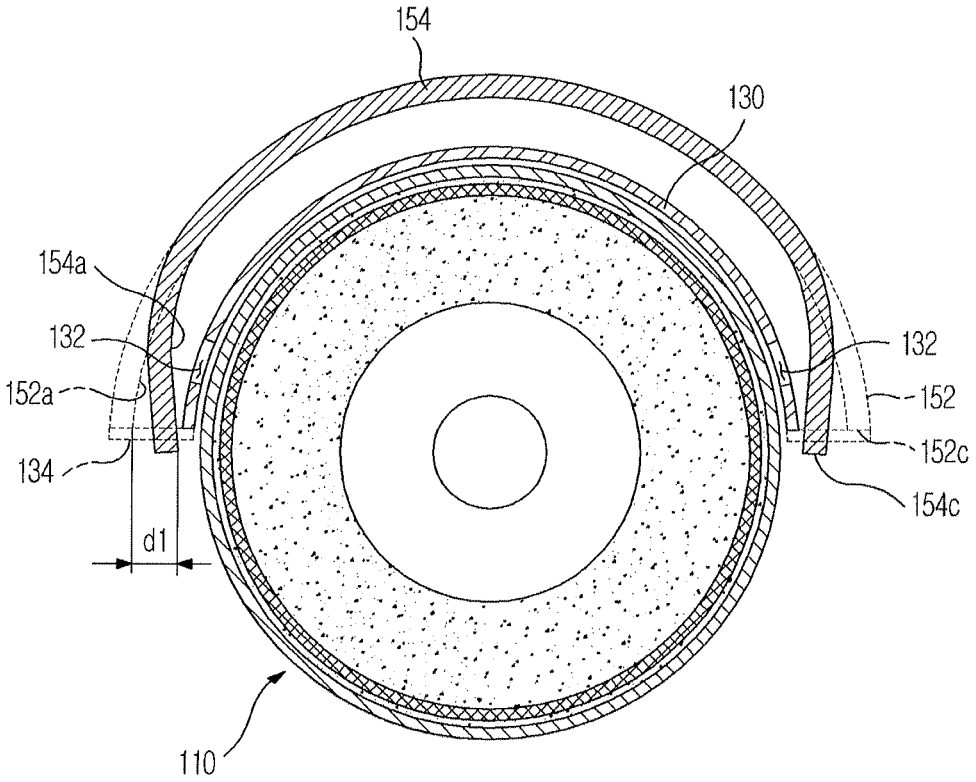
Figure 5:
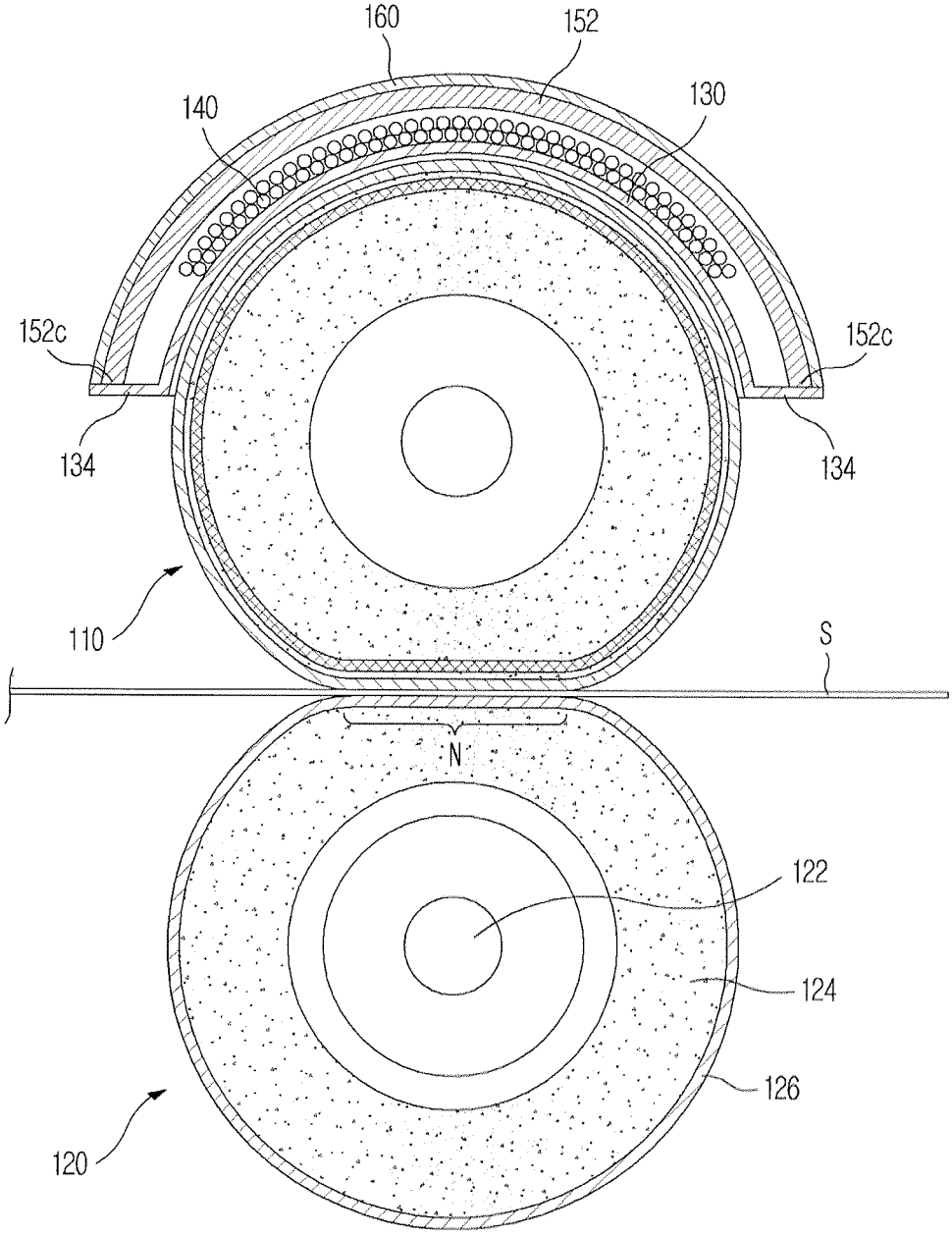

FIGS. 4B, 4C, and 4D illustrate an embodiment in which the ends 154*c* of the second magnetic body 154 is closer to the heating member 110 than the ends 152*c* of the first magnetic body 152. FIG. 4B illustrates the end 154*c* of the second magnetic body 154 having a bend or transition area 154*d* in which the second magnetic body 154 moves from a first plane corresponding to the circumferential bend of the heating member 110 to a second plane closer to the heating member 110 than the first plane.

FIG. 4C illustrates a cross-section of the second magnetic body 154, the inductor cover 130, and the heating member 110 corresponding to a first plane including a point along the axial direction of the heating member 110. The inductor cover extension 134 and the first magnetic body 152 are represented by dashed lines to indicate that they are located along a different plane parallel to the fist plane in the axial direction of the heating member 110. As illustrated in FIG. 4C, the ends 154*c* of the second magnetic body 154 may be located closer to the heating member 110 than the ends 152*c* of the first magnetic body 152. In particular, a first surface 154*a* of the second magnetic body 154 may be located a distance d1 closer to the heating member 110 than a corresponding surface 152*a* of the first magnetic body 152.

The second magnetic body 154 may be bent at a transition portion 154*d* so that a portion of the second magnetic body 154 closer to the end 154*c* of the second magnetic body 154 extends along a plane closer to the heating member 110 than a portion of the second magnetic body 154 on the other side of the transition portion 154*d*. The portion of the second magnetic body 154 that is closer to the heating member 110 may correspond to a portion above the opening 132 as illustrated in FIG. 4C, to facilitate the heating of the second magnetic body 154 by the heating member 110.

FIG. 4D illustrates a second magnetic body 154 having ends 154*c* closer to the heating member 110 than the ends 152*c* of the first magnetic body 152. Unlike the second magnetic body 154 of FIG. 4C, the second magnetic body 154 of FIG. 4D does not have a transition area 154*d* that is bent to form two separate and substantially parallel planes of the second magnetic body 154. Instead, the ends 154*c* of the second magnetic body 154 of FIG. 4D are bent so that the second magnetic body 154 has a curvature steeper than that of the surface of the heating member 110 and steeper than that of the first magnetic body 152. In other words, while the first surface 152*a* of the first magnetic body 152 may be substantially parallel to the surface of the heating member 110, or may have a curvature corresponding to the curvature of the heating member 110, the first surface 154*a* of the second magnetic body 154 may have a curvature steeper than that of the heating member 110 to cause the ends 154*c* of the second magnetic body to be located closer to the surface of the heating member 110 than a center portion of the second magnetic body 154. Similar to the structure of FIG. 4C, the first surface 154*a* of the second magnetic body 154 may be a distance d1 closer to the surface of the heating member 110 than the first surface 152*a* of the first magnetic body 152.

When printing large-sized recording media, the first region 116 and the second regions 118 of the heating member 110 transfer heat to the recording media. At this time, the temperature may be lower at the second regions 118 of the heating member 110 corresponding to ends of the recording media than at the first region 116 of the heating member 110 corresponding to the middle of the recording media, with the result that the fusing performance may be deteriorated.

However, when the ends 154*c* of the second magnetic body 154 adjacent to the heating member 110 are disposed closer to the heating member 110 than the ends 152*c* of the first magnetic body 152 adjacent to the heating member 110, a magnetic field created at the induction coil 140 is relatively intensely concentrated on each of the second regions 118 of the heating member 110, thereby improving induction heating performance at each of the second regions 118 of the heating member 110. Consequently, deterioration of fusing performance at the second regions 118 of the heating member 110 due to temperature lowering is prevented.

Meanwhile, a heat insulation wall 162 may be disposed between the first magnetic body 152 and the second magnetic body 154 disposed adjacent to each other. The heat insulation wall 162 prevents heat directly transferred to the second magnetic body 154 through the opening 132 formed in the inductor cover 130 from being transferred to the first magnetic body 152, thereby preventing the increase in temperature of the first magnetic body 152.

Figure 6:
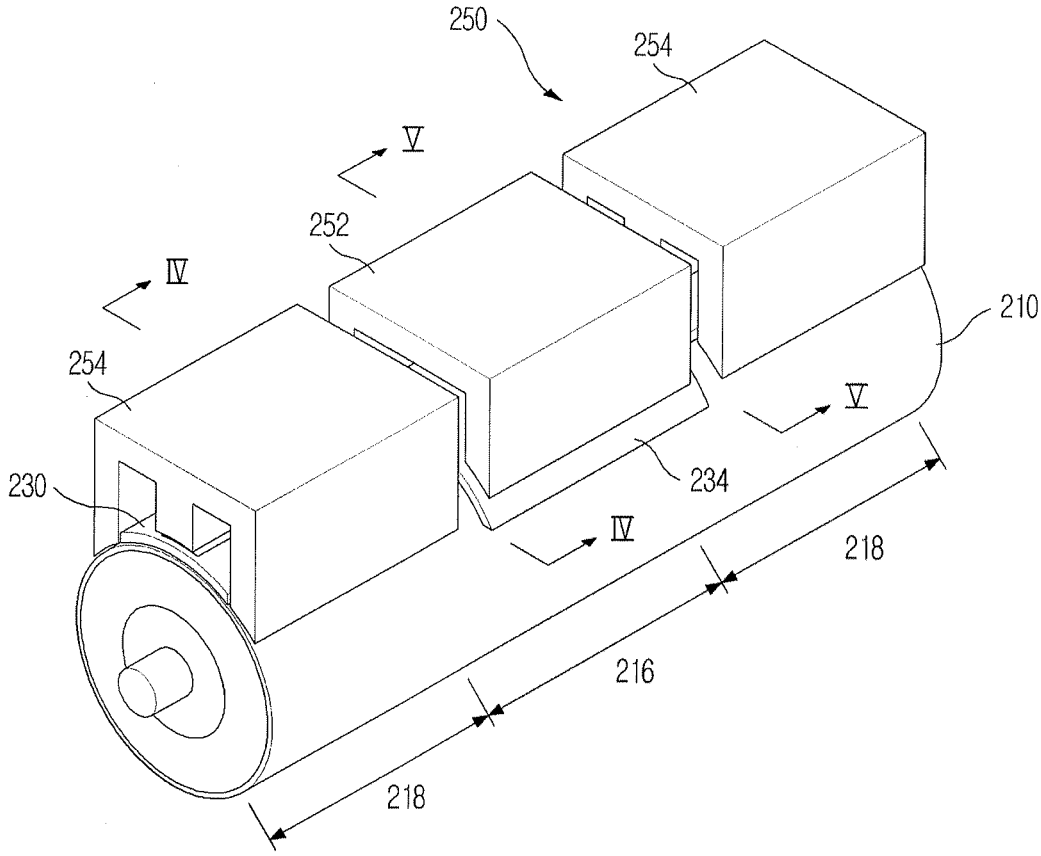
FIG. 6 is a perspective view illustrating a fusing device according to another embodiment of the present general inventive concept.
Figure 7:
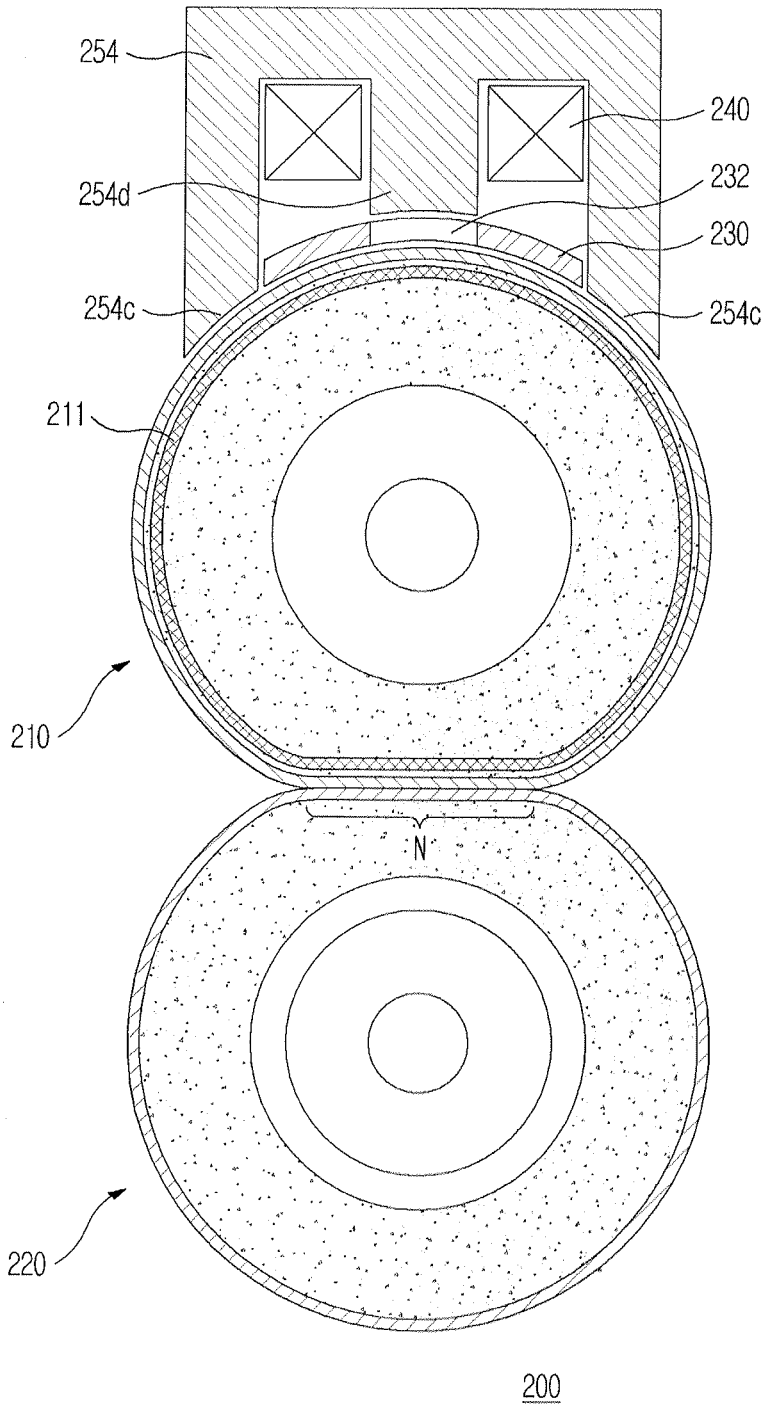
FIG. 7 is a sectional view taken along line IV-IV of FIG. 6.
Figure 8:
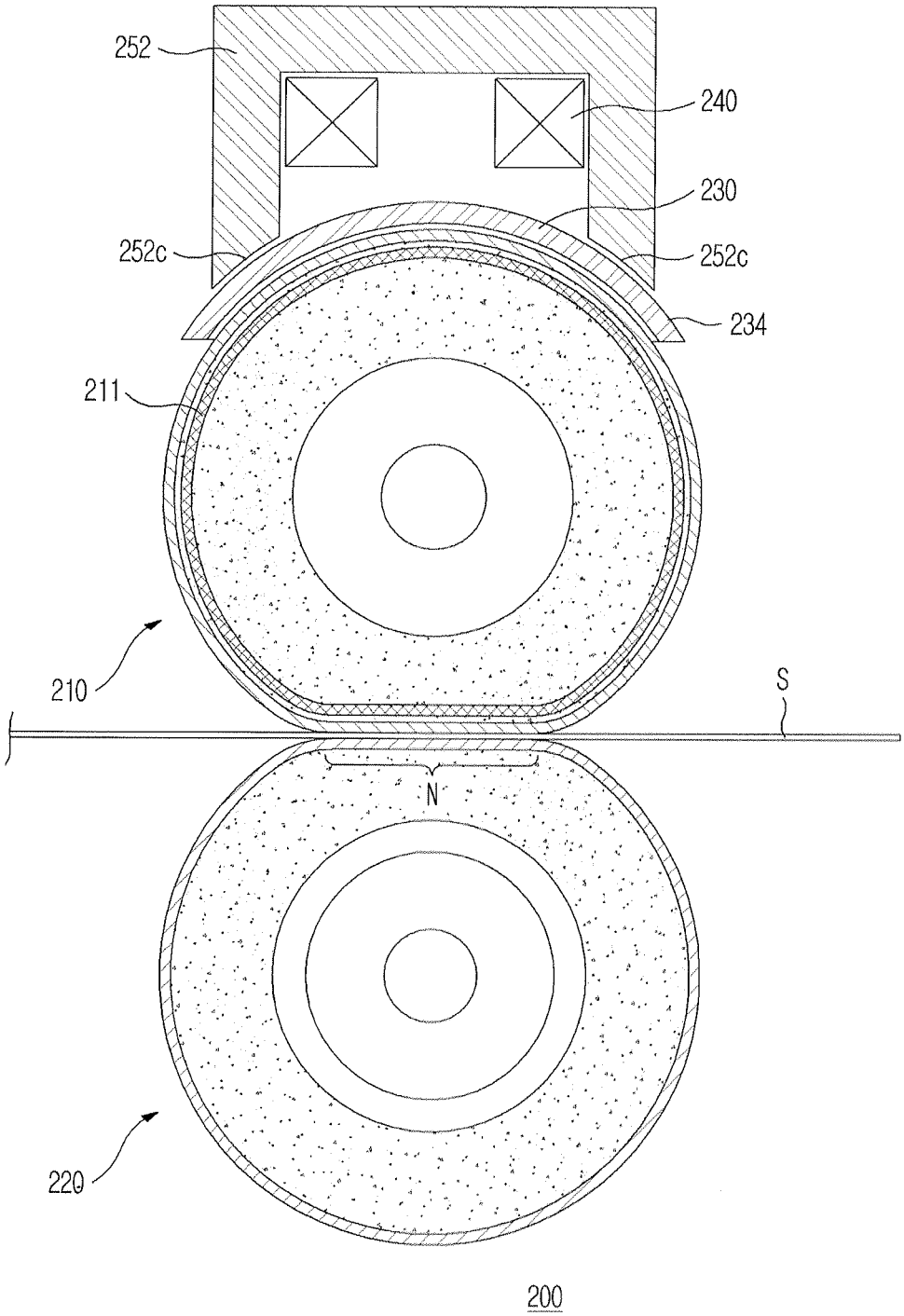
FIG. 8 is a sectional view taken along line V-V of FIG. 6.

FIG. 6 is a perspective view illustrating a fusing device 200 according to another embodiment of the present general inventive concept, FIG. 7 is a sectional view taken along line IV-IV of FIG. 6, and FIG. 8 is a sectional view taken along line V-V of FIG. 6. An induction coil and a pressing member are omitted from FIG. 6.

As shown in FIGS. 6 to 8, the fusing device 200 includes a heating member 210, a pressing member 220, an inductor cover 230, an induction coil 240 and a magnetic flux shielding unit 250.

The heating member 210 has a first region 216 contacting small-sized recording media S when the recording media S pass through a fusing nip N and second regions 218, located at opposite sides of the first region 216, not contacting the small-sized recording media S.

The magnetic flux shielding unit 250 includes a first magnetic body 252 disposed to correspond to the first region 216 of the heating member 210 and a second magnetic body 254 disposed to correspond to each of the second regions 218 of the heating member 210.

The inductor cover 230 is disposed between the magnetic bodies 252 and 254 and the heating member 210. The inductor cover 230 has at least one opening 232 formed to correspond to the second magnetic body 254. The opening 232 allows heat radiated from the heating member 210 to pass through the inductor cover 230 and to directly heat the second magnetic body 254. The opening 232 may be formed at the middle of the inductor cover 230 in the circumferential direction of the heating member 210.

The induction coil 240 is disposed between the magnetic bodies 252 and 254 and the heating member 210 to induction heat a heat emitting part 211 provided at the heating member 210. The induction coil 240 may be disposed at opposite sides of the opening 232 in the circumferential direction of the heating member 210 such that the induction coil 240 does not cover the opening 232 formed in the inductor cover 230.

The second magnetic body 254 may have a protrusion 254*d* protruding toward the opening 232 of the inductor cover 230. The protrusion 254*d* faces the heating member 210 while being adjacent to the opening 232 such that heat radiated from the heating member 210 rapidly increases temperature of the second magnetic body 254. The protrusion 254*d* may be located only on the second magnetic body 254. It may extend a length of the second magnetic body 254 in the axial direction of the heating member 210. The protrusion 254*d* may include only one protrusion or a plurality of protrusions. The protrusion 254*d* may be located at a substantially central portion of the second magnetic body 254 in a direction perpendicular to the axial direction of the heating member 210.

As shown in FIG. 7, ends 254*c* of the second magnetic body 254 may be exposed outside the inductor cover 230 such that the ends 254*c* of the second magnetic body 254 are disposed close to the outer surface of the heating member 210.

Meanwhile, as shown in FIGS. 6 and 8, the portion of the inductor cover 230 corresponding to the first region 216 of the heating member 210 may have extensions 234 extending between ends 252*c* of the first magnetic body 252 and the heating member 210. Heat radiated from the heating member 210 is prevented from being directly transferred to the ends 252*c* of the first magnetic body 252 by the extensions 234 of the inductor cover 230.

As is apparent from the above description, overheating of the heating member is prevented through a simple structure. Also, damage to components and lowering of fusing performance are prevented.

Although a few embodiments of the present general inventive concept have been shown and described, it would be appreciated by those skilled in the art that changes may be made in these embodiments without departing from the principles and spirit of the general inventive concept, the scope of which is defined in the claims and their equivalents.

What is claimed is:

1. A fusing device comprising:

a heating member, having a heat emitting part, disposed to transfer heat to recording media;

an induction coil disposed to create a magnetic field acting upon the heat emitting part;

at least one magnetic body disposed around the induction coil to concentrate the magnetic field created by the induction coil on the heat emitting part; and an inductor cover disposed between the heating member and the at least one magnetic body, wherein the heating member comprises a first region corresponding to a size of the recording media passing through the heating member and a second region outside the first region, and the inductor cover comprises at least one opening formed parallel to a heating member rotational direction at a portion corresponding to the second region of the heating member such that heat generated from the heating member is directly radiated to the at least one magnetic body.

2. The fusing device according to claim 1, wherein the at least one magnetic body comprises:

at least one first magnetic body disposed to correspond to the first region of the heating member; and at least one second magnetic body disposed to correspond to the second region of the heating member.

3. The fusing device according to claim 2, wherein the second magnetic body has lower Curie temperature than the first magnetic body.

4. The fusing device according to claim 2, further comprising a heat transfer layer, made of a material exhibiting higher heat conductivity than the second magnetic body, attached to at least a portion of the second magnetic body.

5. The fusing device according to claim 4, wherein the second magnetic body comprises an inner surface facing the induction coil and an outer surface disposed at a side opposite to the inner surface, and the heat transfer layer is attached to the outer surface of the second magnetic body.

6. The fusing device according to claim 2, wherein the second magnetic body is partially exposed to the heating member by extending past an end of the inductor cover.

7. The fusing device according to claim 2, wherein the first magnetic body and the second magnetic body each have an end located adjacent to the heating member, and the end of the second magnetic body is disposed closer to the heating member than that of the first magnetic body.

8. The fusing device according to claim 2, wherein the at least one second magnetic body comprises a plurality of second magnetic bodies arranged in a longitudinal direction of the heating member, and the at least one opening is disposed to correspond to each of the second magnetic bodies.

9. The fusing device according to claim 2, wherein the second magnetic body comprises at least one protrusion protruding toward the at least one opening.

10. The fusing device according to claim 2, further comprising a heat insulation wall disposed between the first magnetic body and the second magnetic body in a longitudinal direction of the heating member.

11. An image forming apparatus comprising:

a printing device to form an image on recording media; and a fusing device to fix the image to the recording media, the fusing device comprising:

a heating member rotatably disposed to transfer heat to the recording media, the heating member having a first region located at a middle thereof in an axial direction thereof and second regions located at opposite sides of the first region;

an inductor cover disposed to cover an outer surface of the heating member along the axial direction of the heating member;

an induction coil disposed at a side opposite to the heating member with respect to the inductor cover to create a magnetic field;

at least one first magnetic body disposed around the induction coil to concentrate the magnetic field created by the induction coil on the first region of the heating member; and at least one second magnetic body disposed around the induction coil to concentrate the magnetic field created by the induction coil on each of the second regions of the heating member, wherein the inductor cover comprises at least one opening formed parallel to a heating member rotational direction and located only at a position corresponding to at least one of the second regions to allow heat radiated from the heating member to pass through the inductor cover and reach the at least one second magnetic body.

12. The image forming apparatus according to claim 11, wherein the second magnetic body has lower Curie temperature than the first magnetic body.

13. The image forming apparatus according to claim 11, wherein the fusing device further comprises a heat transfer layer, made of a material exhibiting higher heat conductivity than the second magnetic body, attached to the second magnetic body.

14. The image forming apparatus according to claim 11, wherein the second magnetic body has an end located adjacent to the heating member, and the end of the second magnetic body extends past an end of the inductor cover.

15. The image forming apparatus according to claim 11, wherein the at least one opening comprises a plurality of openings arranged at intervals along a circumferential direction of the heating member, and the induction coil is disposed between the openings in the circumferential direction of the heating member.

16. The image forming apparatus according to claim 11, wherein the at least one opening is disposed at a middle of the induction cover in a circumferential direction of the heating member, and the induction coil is disposed at opposite sides of the opening in the circumferential direction of the heating member.

17. A fusing apparatus, comprising:

a heating unit to heat a recording medium;

an induction coil to create a magnetic field to cause the heating unit to emit heat;

a first magnetic body located over a first region of the heating unit to concentrate the magnetic field created by the induction coil on the first region heat emitting part;

a second magnetic body located over a second region of the heating unit to concentrate the magnetic field created by the induction coil on the second region of the heat emitting part, the second magnetic body separated from the first magnetic body in a longitudinal direction of the heating unit; and an inductor cover positioned between the first and second magnetic bodies and the heating unit, the inductor cover comprising at least one opening formed parallel to a heating member rotational direction and located at a location corresponding to a position of the second magnetic body to transmit heat directly to the second magnetic body from the heating unit, wherein the second magnetic body is positioned over the second region of the heating unit to receive a greater magnitude of heat from the heating unit than the first magnetic body receives from the heating unit.

18. The fusing apparatus according to claim 17, wherein the inductor cover includes an extension to cover an end of the first magnetic body, and an end of the second magnetic body is exposed to the heating unit and is not covered by the extension.

19. The fusing apparatus according to claim 17, wherein an end of the second magnetic body extends past an end of the inductor cover to be exposed to the heating unit.

20. The fusing apparatus according to claim 17, wherein an end of the second magnetic body is closer to the outer surface of the heating member than an end of the first magnetic body.

21. The fusing apparatus according to claim 17, wherein the second magnetic body includes a protrusion that extends from a center part of the second magnetic body to the opening of the inductor cover to receive heat from the heating unit via the opening of the inductor cover.

22. The fusing apparatus according to claim 17, wherein the second magnetic body has a Curie temperature lower than a Curie temperature of the first magnetic body.

23. The fusing apparatus according to claim 17, wherein the heating unit is a roller to rotate about a longitudinal axis, the first magnetic body includes a plurality of first magnetic bodies, each having a curved surface adjacent to the surface of the heating unit to correspond to a curvature of the surface of the heating unit, and the second magnetic body includes a plurality of second magnetic bodies having, each having a curved surface adjacent to the surface of the heating unit to correspond to a curvature of the surface of the heating unit.

24. The fusing apparatus according to claim 23, wherein the second magnetic body includes first and second pluralities of second magnetic bodies located on either side of the first magnetic body in the longitudinal direction of the heating unit.

* * * * *